US005392994A

United States Patent [19]

Zizelman et al.

[11] Patent Number: 5,392,994

[45] Date of Patent: Feb. 28, 1995

[54] FUEL INJECTION NOZZLE

[75] Inventors: James Zizelman, Rochester; Corrine A. Volo, Webster; Roland S. Taylor, Honeoye Falls; Jeffrey A. Rock, West Henrietta, all of N.Y.

[73] Assignee: General Motors Corporation, Detroit, Mich.

[21] Appl. No.: 143,595

[22] Filed: Nov. 1, 1993

[51] Int. Cl.[6] ..... F02M 55/02

[52] U.S. Cl. ..... 239/533.9; 239/101

[58] Field of Search ..... 239/533.8, 570, 571, 239/960, 533.3–533.12, 101

[56] References Cited

U.S. PATENT DOCUMENTS

| | | | |
|---|---|---|---|
| 2,756,106 | 7/1956 | Schenk | 299/107.6 |
| 2,812,979 | 11/1957 | Ziesche et al. | 239/571 |
| 3,237,568 | 3/1966 | Morgan et al. | 239/533.8 X |
| 4,641,784 | 2/1987 | Howes | 239/533.8 X |
| 5,070,845 | 12/1991 | Avdenko et al. | 123/470 |
| 5,188,142 | 2/1993 | Lind et al. | 137/223 |

FOREIGN PATENT DOCUMENTS

| | | | |
|---|---|---|---|
| 54612 | 1/1982 | Germany | 239/533.8 |

*Primary Examiner*—Andres Kashnikow

*Assistant Examiner*—Kevin P. Weldon

*Attorney, Agent, or Firm*—Karl F. Barr, Jr.

[57] ABSTRACT

A fuel system is disclosed having a fuel nozzle which receives pulsed, pressurized fuel for injection into the intake of an engine. The nozzle has a valve seat assembly with an upstream and a downstream seat interconnected by a longitudinal passage and by a bypass extending from upstream of the first seat to a location intermediate of the two seats. A poppet valve assembly has interconnected upstream and a downstream valve members operable relative to respective valve seats to regulate flow through the nozzle. A biasing member urges the valve member into a closed position in which the upstream valve member is unseated and the downstream valve member is seated to interrupt flow therethrough and out of the nozzle. Introduction of a fuel pulse into the nozzle moves the upstream valve member into engagement with its valve seat to thereby unseat the downstream valve member to allow fuel flow through the bypass around the upstream valve/seat and out of the nozzle through the open, downstream valve/-seat. The bypass defines a fixed orifice for fuel flow through the nozzle and can produce a majority of the pressure drop and fuel metering functioning the fuel system.

5 Claims, 3 Drawing Sheets

FUEL INJECTION NOZZLE

TECHNICAL FIELD

The invention relates to a nozzle for discharging fuel to an internal combustion engine and, more particularly to such a nozzle having flow control by means of a bypass.

BACKGROUND

In the fuel injection system set forth in U.S. Pat. No. 5,070,845 issued Dec. 10, 1991 to Avdenko et al., a fuel system is disclosed having an injector for metering fuel to a plurality of fuel nozzles. Fuel is distributed through individual fuel lines and is discharged via the nozzles at locations adjacent the engine intake ports. The nozzle disclosed in Avdenko et al., has a body with a tubular seat member having a valve seat with an opening for the discharge of fuel therethrough. A poppet valve member is operable, relative to the seat, to interrupt fuel flow through the opening and an extension spring anchored to the nozzle body and to the valve member, urges the valve into a normally seated position against the valve seat.

The nozzle body is adapted to receive fuel through a restriction member that limits fuel flow therethrough, however, the popper itself cannot act as fixed orifice, and therefore cannot provide any flow metering function. The resulting fuel flow through the nozzle is sensitive to variations in supply fuel pressure.

SUMMARY OF THE INVENTION

The disclosed invention provides an improved nozzle suitable for use in a fuel injection system in which pressurized fuel is metered to a nozzle.

In a fuel injection nozzle according to the present invention, a tubular nozzle body, adapted to receive fuel, includes a valve seat assembly having first, upstream and second, downstream valve seats, interconnected by a longitudinally extending passage. One or more fluid passages or bypasses extend from a point upstream of the first valve seat to a location intermediate of the two valve seats. A poppet valve assembly includes first, upstream and second, downstream valve members operable to engage their respective upstream and downstream valve seats to regulate fluid flow through the valve assembly. The valve members are operably connected and fixed, relative to one another to thereby define the longitudinal movement or stroke of the valve assembly. The valve member is urged, by a spring member, towards a normally closed position in which the upstream valve member is in an unseated position relative to its associated upstream seat and the downstream valve member is seated against its associated, downstream seat. Introduction of a high pressure pulse of fluid into the tubular nozzle body will cause the valve member to move towards an open position in which the upstream valve member is in a seated position and the downstream valve member is unseated to allow flow through the bypass and out of the injector nozzle through the open downstream valve seat.

The bypass establishes a fluid path around the upstream valve and seat and functions as a fixed orifice for flow through the nozzle. The orifice/bypass is simpler to machine accurately than the valve/seat combination typically used exclusively to control flow through such nozzles.

In addition, the bypass outlets may be oriented to establish a desired flow pattern within the nozzle to enhance atomization of fluid exiting the nozzle.

Also, with the upper valve member functioning as a stroke limiter, flow fluctuations are significantly reduced.

The details as well as other features and advantages of the preferred embodiments of the fuel injection nozzle employing the features provided by this invention are set forth in the following detailed description and drawings.

DETAILED DESCRIPTION

Figure 1:
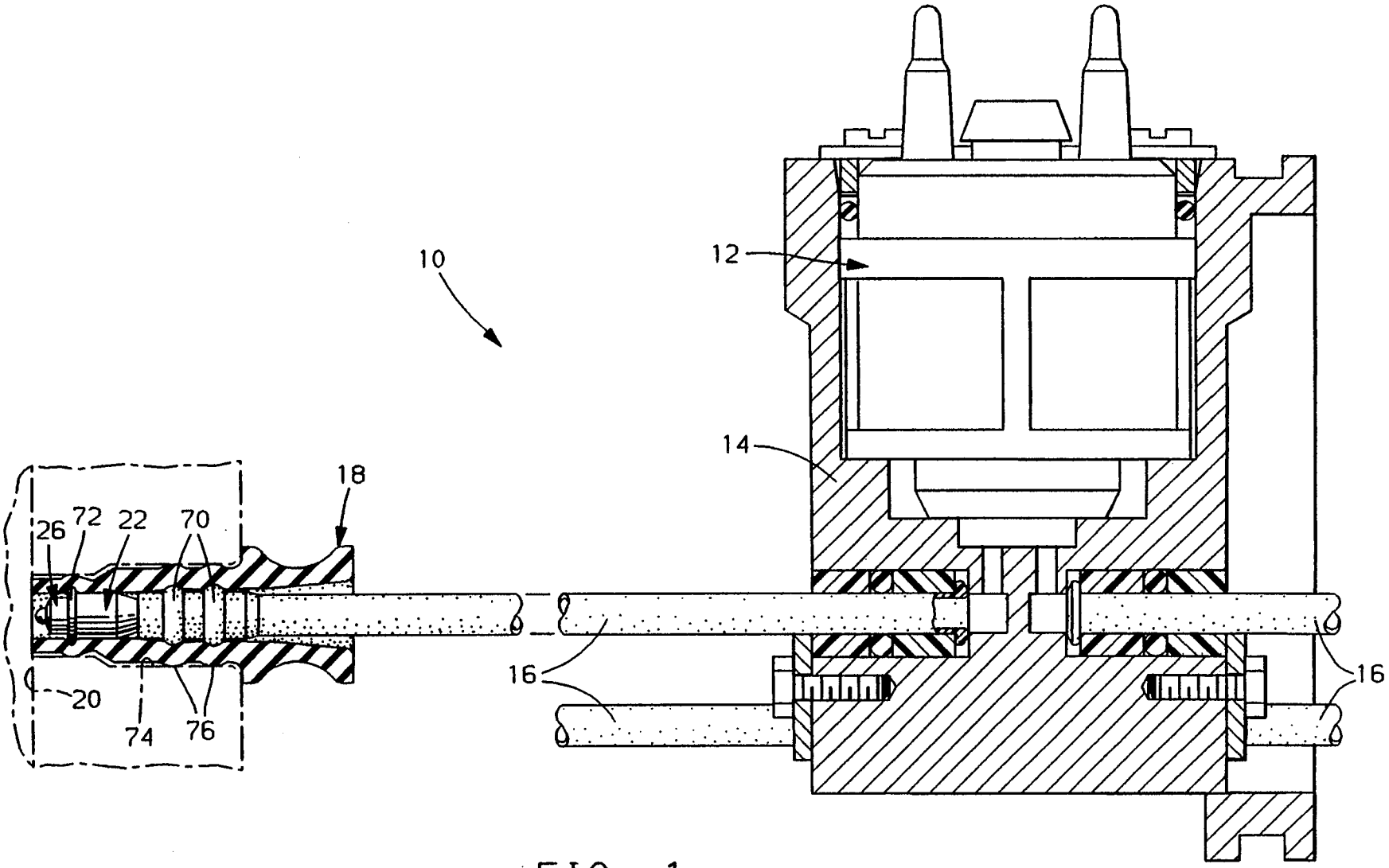
FIG. 1 shows a fuel injection system that meters fuel through a fuel line to a nozzle employing features of the present invention.

Referring to the drawings, FIG. 1 illustrates a fuel injection system, designated generally as 10, for delivery of fuel to the intake system of an internal combustion engine, not shown. An injector 12 is mounted in a fuel meter body 14 and is supplied fuel at a desired pressure. Injector 12 meters the fuel, in the form of pressurized pulses, to a fuel distribution line 16. Each line 16 terminates at a fuel injection nozzle 18 that discharges the metered fuel into the stream of air flowing through an inlet port 20 to a combustion chamber of the engine.

Figure 2:
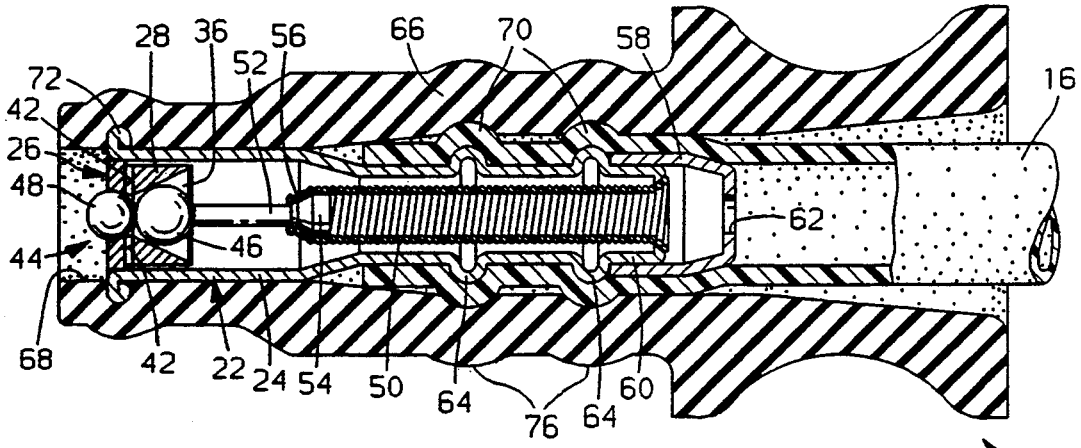
FIG. 2 is an enlarged, sectional view of a portion of the FIG. 1 nozzle removed from the engine and the fuel meter body, showing details of its construction.

As shown in FIG. 2, nozzle 18 has a tubular body 22 adapted to receive fuel from its associated fuel line 16. The downstream end of the body 22 has an enlarged diameter portion 24 configured to receive a tubular valve seat assembly 26. The seat assembly 26, FIGS. 3 and 4, has a tubular valve seat body 28 with an outer wall 32 for engagement with the inner portion of the enlarged diameter portion 24 of the tubular body 22. Valve seat body 28 is fixed within the enlarged portion 24 such as by an interference fit between the two components, or by welding, or otherwise bonding, so as to establish a leak free seal therebetween and to support the valve seat assembly 26 within tubular nozzle body 22. Flats 30, FIG. 5, in outer wall 32 of valve seat body 28 extend from the upstream end of the body 28 towards the downstream end to terminate at a location intermediate of the two ends, defining passages 34 between tubular body 22 and valve body 28. Valve seat body 28 has a passage 36 extending longitudinally from the upstream to the downstream ends with a first, upstream valve seat 38 and a second, downstream valve seat 40 extending about opposite ends of the passage 36 such that the valve seats are situated in spaced relationship from one another with the seating surface of the upstream valve seat 38 facing upstream and the seating surface of the downstream valve seat 40 facing downstream.

Figure 5:
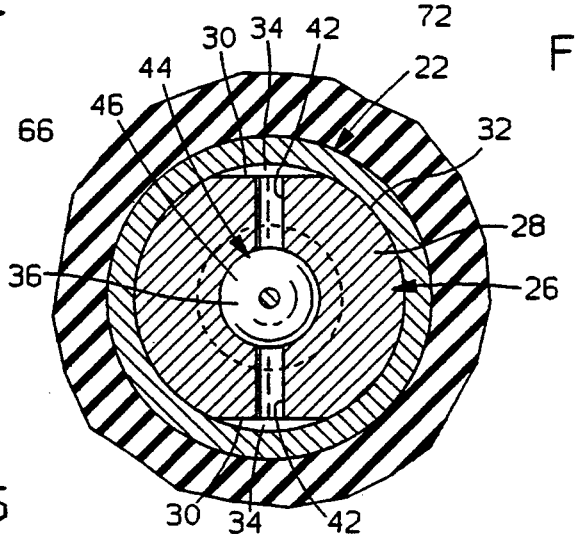
FIG. 5 is a sectional view of the nozzle of FIG. 2 taken along line 5—5 of FIG. 3.
Figure 6:
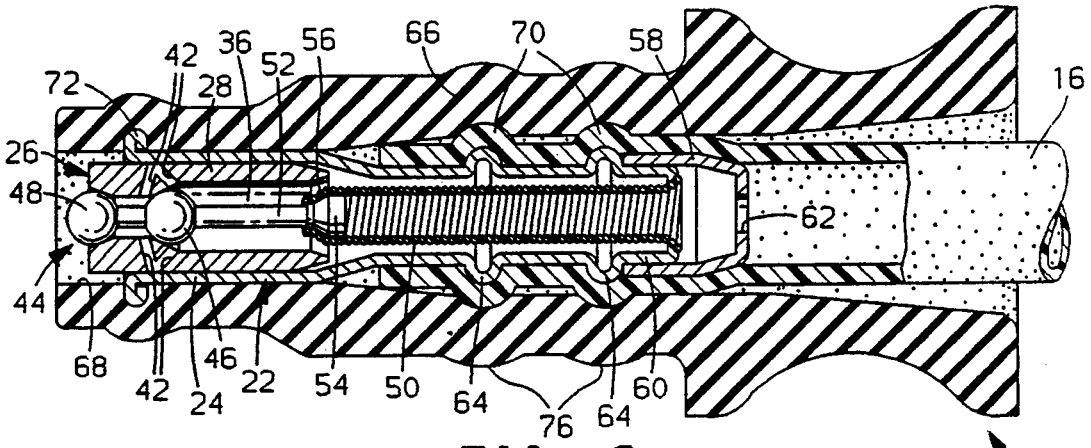
FIG. 6 is an enlarged, sectional view of a second embodiment of the nozzle shown in FIG. 1.
Figure 7:
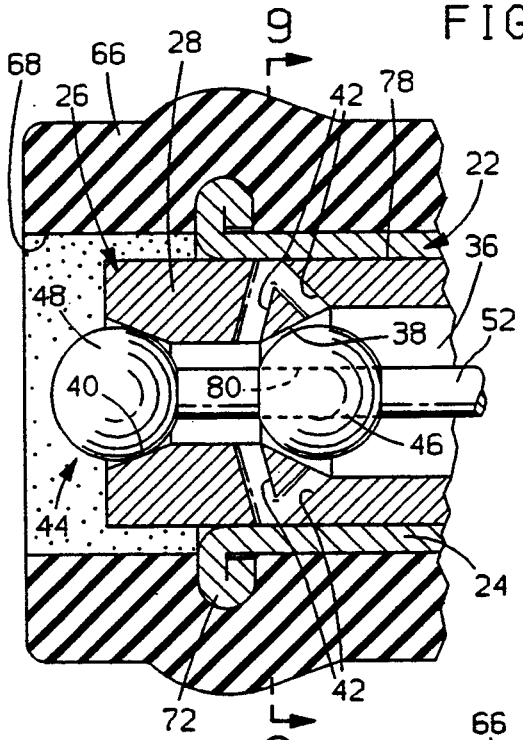
FIGS. 7 and 8 are enlarged partial sectional views of the nozzle of FIG. 6, illustrating various modes of operation.
Figure 8:
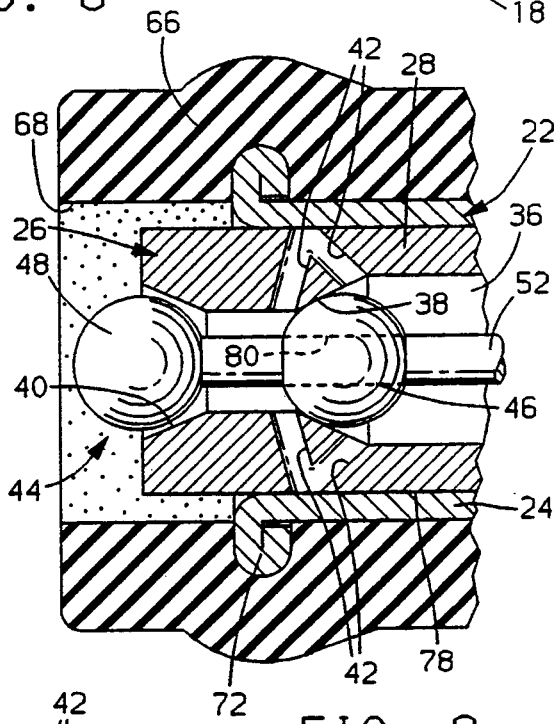

One or more fluid passages or bypasses 42 are formed in the valve seat body 28 and extend radially inwardly, FIG. 5, from the passages 34, defined by flats 30, to a location within passage 36, intermediate of the upstream and downstream valve seats 38,40. As such, the passages 34 and 42 define fluid bypasses from a location upstream of the first valve seat 38 to a position downstream thereof.

A valve assembly, designated generally as 44, includes a first, upstream valve member 46 engageable with upstream valve seat 38 to interrupt flow from within the tubular body 22 into longitudinal passage 36, and a second, downstream valve member 48 engageable with downstream valve seat 40 to interrupt flow from passage 36 and out of the nozzle 18. In the embodiment illustrated in FIGS. 2–5, the valve members 46,48 are defined by two spherical members, such as ball bearings. The passage 36 through valve seat body 28 is configured to allow the ball bearing valve members 46,48 to contact tangentially along their surfaces where they are joined, as by welding, to form a unitary valve assembly 44. The radii of the two valve members need not necessarily be equal, however, the radii, in conjunction with the geometry of the valve seats 38,40, determine the overall longitudinal movement or stroke of the valve assembly 44 relative to the valve seats.

A helically coiled extension spring 50 is anchored to tubular body 22 and to first, upstream valve member 46 through a shank 52 which is attached to the valve member through welding or bonding at one end. The shank 52 has a head 54 which is surrounded by a section of reduced coils 56 of extension spring 50 to anchor the spring to the valve member. The spring 50 is operable to urge the valve assembly 44 towards the upstream, closed direction such that first, upstream valve member 46 is normally lifted off of its associated valve seat 38 and second, downstream valve member 48 is normally biased to engage its associated valve seat 40. Upon introduction of a high pressure pulse of fuel into the tubular body 22 causing the pressure differential across valve assembly 44 to reach a desired level, the bias exerted thereon by the extension spring 50 is overcome and the valve assembly is moved in the downstream, open direction such that the first, upstream valve member 46 is urged into engagement with its associated valve seat 38 and the second, downstream valve member 48 is displaced from seat 40. In the opened position, fuel flows from nozzle body 22 through passages 34 and 42 and out of the injector nozzle 18 through the open downstream valve seat 40. The axial position of the valve seat assembly 26 within the nozzle body 22 is adjustable during assembly to adjust the length of the spring 50 and, as a result, the bias exerted by the spring on the valve assembly 44. The adjustment feature allows calibration of the pressure differential across valve seat assembly 26 at which the valve members are displaced from their respective valve seats.

Figure 9:
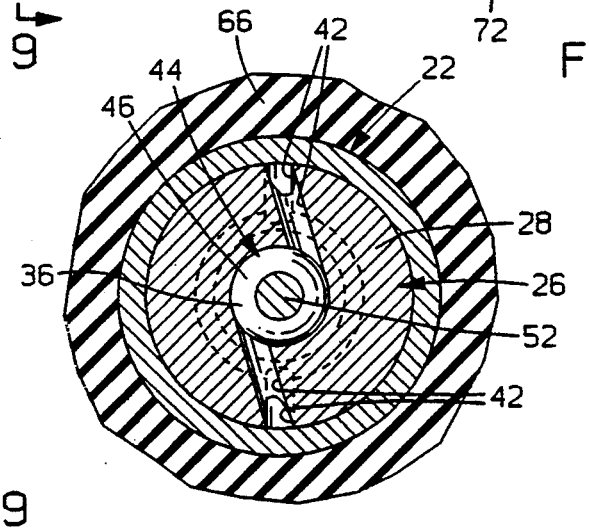
FIG. 9 is a sectional view of the nozzle of FIG. 7 taken along line 9—9 of FIG. 7.

The bypass passages 34,42 define a fluid path around the first, upstream valve member 46 and its associated valve seat 38. Upon the introduction of a fuel pulse sufficient to overcome the bias of spring 50, fuel is delivered through the bypass into the fuel passage 36 intermediate of the closed first, upstream valve and seat 46,38, and the open second, downstream valve and seat 48,40. The passages 42 function as fixed orifices for fuel flow through the nozzle 18 and produce the majority of the pressure drop in the fuel system 10. In addition, the fixed orifice bypass design provided by the present nozzle provides the primary fuel metering function in the fuel system 10. Fuel exiting the passages 42 into the passage 36 between the valve seats 38,40 is atomized under the influence of the pressure drop and, in addition, the swirl induced by the orientation of the passages 42. As is illustrated in FIG. 5 and in FIG. 9, which shows a second embodiment of the nozzle to be described in further detail below, the orientation of passages 42, relative to passage 36 through valve body 28 may vary in order to affect the direction of fuel flow within passage 36, thereby optimizing atomization of the fuel exiting nozzle 18. The atomized fuel exits the fuel injection nozzle 18 through the open valve and seat 48,40. The seated upstream valve member 46 is operable when the valve assembly is in the open position to limit the opening of the second, downstream valve member relative to its seat 48. The mechanical stop function of the upper valve member 46 prevents oscillation of the second valve member 48 during the full-on condition of the nozzle resulting in a stabilization of fluid flow out of the nozzle 18. Termination of the fuel pulse results in a movement of the valve assembly 44 towards the closed, upstream position illustrated in FIG. 3 wherein the second valve member 48 closes against valve seat 48 and the first, upstream valve member 46 lifts off of its seated position against the valve seat 38 under the bias of the spring 50.

Figure 3:
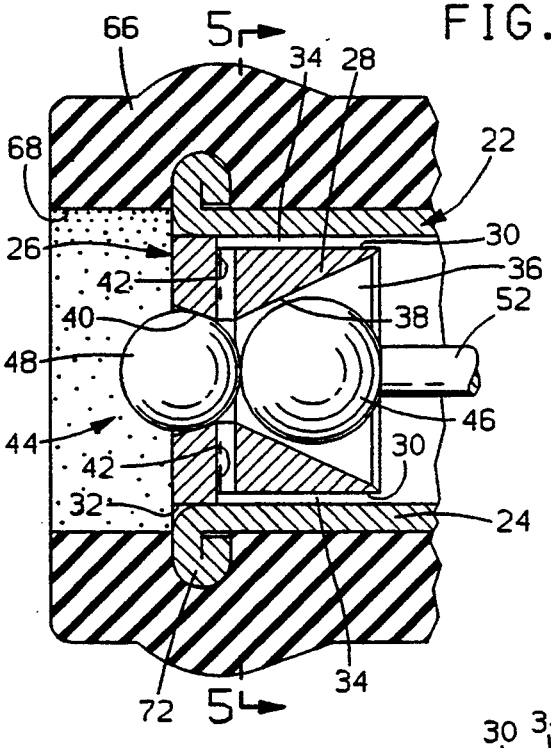
FIGS. 3 and 4 are enlarged partial sectional views of the nozzle of FIG. 2, illustrating various modes of operation.
Figure 4:
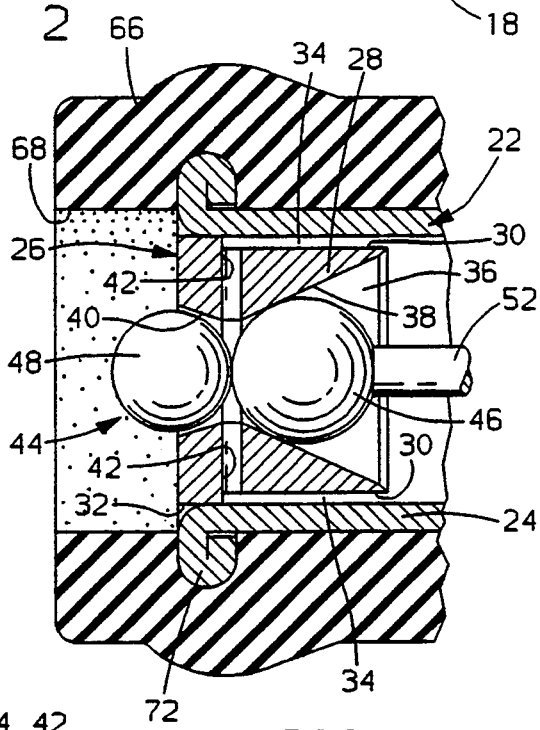

The two valve/seat configuration of the present fuel injection nozzle 18 provides a metering function which is less sensitive to variations in supply fuel pressure and component pressure drops than typical single valve designs. By varying the relative diameters of the two valve members, as is illustrated in FIGS. 3 and 4, performance of the nozzle is affected. In the FIGS., upstream valve member 46 has a larger diameter than downstream member 48. The larger diameter of valve member 46 provides greater surface area upon which pressurized fuel acts to open the valve and initiate the injection event. As a result of the increased valve area, opening rates are reduced and the dynamic range of the nozzle is increased. The relative insensitivity to changes in pressure allows the design and manufacture of the nozzle and other components of the fuel system with wider tolerance on pressure drop thereby significantly reducing manufacturing complexity and cost.

A restriction member 58 may be received over the upstream end 60 of the nozzle body 22 and has a calibrated orifice 62 that limits fuel flow into nozzle 18. Placement of an orifice 62 at the upstream end of each nozzle assures that fuel is distributed equally to all nozzles in a system, such as that shown in FIG. 1, in which fuel is distributed to multiple nozzles from a single metering source.

Fuel distribution line 16 is slipped over nozzle body 22 and expands to fit over a pair of peripheral beads 64 formed on the body. A mounting bushing 66 has a central bore 68 that embraces portions of the fuel nozzle 18 and distribution line 16. Within the bore 68, an annular groove receives a peripheral locating flange 72 extending outwardly from the nozzle body 22 to retain the body within mounting bushing 66.

The mounting bushing 66 is insertable into an aperture 74 in the wall of inlet port 20 in the engine and is fixed in position using suitable means such as a series of peripheral beads 76 that engage the inlet port wall, positive engagement cups formed integrally with bushing 66 or, separate retaining plates or clamps which are well known.

Fuel distribution line 16 is flexible and bends to allow bushing 66 to mount nozzle 18 at the correct angle; fuel line 16 is shown in the figures as a straight tube only for convenience.

A second embodiment of the fuel injection nozzle embodying the present invention is illustrated in FIGS. 6 through 9. In the figures, features similar to those described above and shown in FIGS. 1 through 5, are identified by like numerals.

Referring to the figures, the tubular body 22 of fuel injector nozzle 18 receives tubular valve seat assembly 26 in an enlarged, downstream end portion 24. The seat assembly 26, FIGS. 7, 8 and 9, includes a tubular valve seat body 28 with an outer wall 78 configured to slidingly engage the inner wall of the enlarged, downstream end portion 24 of the tubular body 22. The seat body 28 is fixed within the tubular body 22, such as by welding, to establish a leak-free seal therebetween.

The valve seat body 28 has a passage 36 extending from the upstream to the downstream ends with a first upstream valve seat 38 and a second, downstream valve seat 40 extending about opposite ends of the passage 36 such that the valve seats are situated in spaced relationship to one another with the seating surface of the upstream valve seat facing upstream and the seating surface of the downstream valve seat facing downstream.

One or more fluid passages or bypasses 42 are formed in the valve seat body 28 and extend from a location upstream of the first, upstream valve seat 38 to a location within passage 36 intermediate of the valve seats 38,40 to define fluid bypasses around the first, upstream valve seat 38.

A valve assembly 44 includes first, upstream valve member 46 and second, downstream valve member 48. The valve members engage their respective upstream and downstream valve seats 38,40 to interrupt flow therethrough. The valve members are defined by two spherical members, such as ball bearings. A shank 52 is connected to the downstream valve member 48, such as by welding, and extends longitudinally upstream through passage 36, and into the nozzle body 22. The first, upstream valve member 46 has a bore 80 configured to slidingly receive the shank 52. The valve member 46 is positioned on the shank 52 and fixed in place to define the distance between the valve members 46,48 and to define the overall longitudinal movement or stroke of the valve assembly 44 relative to the valve seats 38,40. Helically coiled extension spring 50 is anchored to the tubular body 22 and to the upstream end of the shank 52. The shank 52 has a head 54 which is surrounded by a reduced coil section 56 of spring 50 which act to anchor the spring to the shank and, consequently, to the valve assembly 44. The spring urges the valve assembly 44 towards the upstream closed direction such that first, upstream valve member 46 is normally lifted off of associated upstream valve seat 38 and second, downstream valve member 48 is normally biased to engage its associated valve seat 40 to thereby prevent flow of fuel out of fuel injection nozzle 18.

Upon introduction of a pressurized fuel pulse sufficient to overcome the bias exerted on the valve assembly 44 by spring 50, the valve assembly is moved towards an open, downstream position such that the first, upstream valve member 46 is seated against valve seat 38 and the second, downstream valve member 48 is displaced from its seat 40. In the opened position fuel flows through bypass passages 42 and out of the injector nozzle 18 through the opened valve and seat 48,40, respectively.

The present invention discloses a fuel injection nozzle having a dual valve/seat assembly with flow control by means of a bypass. The valve/seat assembly utilizes upstream and downstream valve members which are operably fixed together and function, relative to their associated valve seats in an on/off function relative to fuel flow. A bypass in the nozzle acts as a fixed orifice for fuel flow and can produce the majority of the pressure drop and fuel metering in the fuel system.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiments may be modified in light of the above teachings. The embodiments described were chosen to provide an illustration of the principles of the invention and its practical application to thereby enable one of ordinary skill in the art to utilize the invention in various embodiments and with various modifications as are suited to the particular use contemplated. Therefore the foregoing description is to be considered exemplary, rather than limiting, and the true scope of the invention is that described in the following claims.

The embodiments of the invention in which an exclusive property or privilege is claimed are defined as follows:

1. A fuel injection nozzle adapted to receive pulsed pressurized fuel from a source, comprising a valve seat assembly having a valve seat body with a longitudinally extending passage extending from an upstream end to a downstream end, and having a first, upstream seat extending about said passage at said upstream end and a second, downstream seat extending about said passage at said downstream end, wherein said upstream seat is in fluid communication with said downstream seat through said passage, and a bypass extending from upstream of said first seat to a location between said seats, said nozzle further comprising a valve assembly having a first, upstream valve member engageable with said upstream valve seat to regulate fuel flow through said upstream valve seat and to said downstream valve seat through said passage, a second, downstream valve member engageable with said downstream valve seat to regulate the flow of fuel therethrough, means connecting said first and second valve members relative to one another through said passage, and biasing means operable to urge said valve assembly in an upstream direction, against the force of said pressurized fuel source, such that said first valve member is displaced from said first valve seat and said second valve member is biased into engagement with said second valve seat to interrupt fuel flow through said second valve seat and out of said nozzle, said pulsed pressurized fuel operable to establish intermittent pressure differentials across said valve assembly to thereby overcome the force of said biasing means and urge said valve assembly downstream such that said first valve member is biased to engage said first valve seat to interrupt fuel flow therethrough and said second valve member is displaced from said second valve seat to permit fuel flow through said bypass to said location between said valve seats and out of said nozzle through said second, downstream valve seat.

2. A fuel injection nozzle comprising a tubular body with an inlet adapted to receive pulsed pressurized fuel from a source at a first end of said body, and a valve seat assembly mounted within a second end of said tubular body comprising a valve body with a first, upstream seat and a second, downstream seat, said seats interconnected, and extending about, a passage extending longitudinally through said valve body, said upstream seat having an upstream facing seating surface and said downstream seat having a downstream facing seating surface, and a bypass extending from upstream of said first seat to terminate in said passage at a location intermediate of said seats, said nozzle further comprising a valve assembly having a first, upstream valve member operable with respect to said upstream valve seat to regulate fuel flow through said upstream valve seat and to said downstream valve seat through said passage, a second, downstream valve member engageable with said downstream valve seat to regulate the flow of fuel therethrough, means connecting said first and second valve members relative to one another through said passage, and biasing means operable to urge said valve assembly in an upstream direction, against the force of said pressurized fuel source, such that said first, upstream valve member is displaced from said first, upstream valve seat and said second, downstream valve member is biased into engagement with said second, downstream valve seat to interrupt fuel flow through said second valve seat and out of said nozzle and to fluidly connect said downstream valve member with said inlet through said bypass and said passage, said pulsed pressurized fuel operable to establish intermittent pressure differentials across said valve seat assembly to thereby overcome the force of said biasing means and urge said valve assembly in a downstream direction such that said first valve member is biased to engage said first valve seat to interrupt fuel flow from said inlet to said second, downstream valve member through said passage, and said second valve member is displaced from said second valve seat to permit fuel flow through said bypass to said location between said valve seats and out of said nozzle through said second, downstream valve seat.

3. A fuel injection nozzle comprising a tubular body with an inlet adapted to receive pulsed pressurized fuel from a source at a first end of said body, and a valve seat assembly mounted within a second end of said tubular body comprising a valve body with a first, upstream seat and a second, downstream seat, said seats interconnected, and extending about, a passage extending longitudinally through said valve body, said upstream seat having an upstream facing seating surface and said downstream seat having a downstream facing seating surface, and a bypass extending from upstream of said first seat to terminate in said passage at a location intermediate of said seats, said nozzle further comprising a valve assembly having a first, upstream valve member operable with respect to said upstream valve seat to regulate fuel flow through said upstream valve seat and to said downstream valve seat through said passage, a second, downstream valve member engageable with said downstream valve seat to regulate the flow of fuel therethrough, means connecting said first and second valve members relative to one another through said passage, said connecting means defining the stroke of said valve assembly relative to said seat assembly, and biasing means operable to normally urge said valve assembly in an upstream direction, against the force of said pressurized fuel source, such that said first, upstream valve member is displaced from said first, upstream valve seat and said second, downstream valve member is biased into engagement with said second, downstream valve seat to interrupt fuel flow through said second valve seat and out of said nozzle and to fluidly connect said downstream valve member with said inlet through said bypass and said passage, said pulsed pressurized fuel operable to establish intermittent pressure differentials across said valve seat assembly to thereby overcome the force of said biasing means and urge said valve assembly in a downstream direction such that said first valve member is biased to engage said first valve seat to interrupt fuel flow from said inlet to said second, downstream valve member through said passage, and said second valve member is displaced from said second valve seat to permit fuel flow through said bypass to said location between said valve seats and out of said nozzle through said second, downstream valve seat, said bypass presenting a fixed, fluid metering orifice to flow through said nozzle.

4. A fuel injection nozzle comprising a tubular body with an inlet adapted to receive pulsed pressurized fuel from a source at a first end of said body, and a valve seat assembly mounted within a second end of said tubular body comprising a valve body with a first, upstream seat and a second, downstream seat, said seats interconnected, and extending about, a passage extending longitudinally through said valve body, said upstream seat having an upstream facing seating surface and said downstream seat having a downstream facing seating surface, and a bypass extending from upstream of said first seat to terminate in said passage at a location intermediate of said seats, said nozzle further comprising a valve assembly having a first, upstream valve member operable with respect to said upstream valve seat to regulate fuel flow through said upstream valve seat and to said downstream valve seat through said passage, a second, downstream valve member engageable with said downstream valve seat to regulate the flow of fuel therethrough, means connecting said first and second valve members relative to one another through said passage, said connecting means defining the stroke of said valve assembly relative to said seat assembly, and biasing means operable to normally urge said valve assembly in an upstream direction, against the force of said pressurized fuel source, such that said first, upstream valve member is displaced from said first, upstream valve seat and said second, downstream valve member is biased into engagement with said second, downstream valve seat to interrupt fuel flow through said second valve seat and out of said nozzle and to fluidly connect said downstream valve member with said inlet through said bypass and said passage, said pulsed pressurized fuel operable to establish intermittent pressure differentials across said valve seat assembly to thereby overcome the force of said biasing means and urge said valve assembly in a downstream direction such that said first valve member is biased to engage said first valve seat to interrupt fuel flow from said inlet to said second, downstream valve member through said passage, and said second valve member is displaced from said second valve seat to permit fuel flow through said bypass to said passage location between said valve seats and out of said nozzle through said second, downstream valve seat, said first, upstream valve member operable as a stroke limiting valve stop relative to said second, downstream valve member to limit movement of said valve member off of said second, downstream valve seat and said bypass defining a fixed fluid metering orifice operable to meter flow through said nozzle.

5. A fuel injection nozzle adapted to receive pulsed pressurized fuel from a source, comprising a valve seat assembly having a valve body with a first, upstream seat and a second, downstream seat, said seats interconnected by a passage extending longitudinally through said valve body and bypass means extending from a location upstream of said first valve seat to terminate in said passage at a location intermediate of said seats, said nozzle further comprising a valve assembly having a first, upstream valve member operable with respect to said upstream valve seat to regulate flow therethrough, and a second, downstream valve member engageable with said downstream valve seat to regulate the flow of fuel therethrough, said valve members comprising spherical members in tangential contact across said passage and fixed at said point of contact to define a singular valve member having combined radii operable to define the stroke of said singular valve member relative to said valve seat assembly, and biasing means operable to normally urge said valve assembly in a closed direction against the force of said pressurized fuel source, such that said first, upstream valve member is displaced from said first, upstream valve seat and said second, downstream valve member is biased into engagement with said second, downstream valve seat to interrupt flow through said second valve seat and out of said nozzle, said pulsed pressurized fuel operable to establish intermittent pressure differentials across said valve body to thereby overcome the closing force of said biasing means and urge said valve member towards an open position such that said first valve member is biased to engage said first valve seat to interrupt flow therethrough and said second spherical valve member is displaced from said second valve seat to permit fuel flow through said bypass to said passage location between said valve seats and out of said nozzle through said second, downstream valve seat.

* * * * *